US010099353B2

(12) United States Patent
Nishimiya et al.

(10) Patent No.: US 10,099,353 B2
(45) Date of Patent: Oct. 16, 2018

(54) NUT-FASTENING TOOL

(71) Applicant: MAKITA CORPORATION, Anjo-shi, Aichi (JP)

(72) Inventors: Takeshi Nishimiya, Anjo (JP); Kazunori Tsuge, Anjo (JP); Nobuyasu Furui, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 161 days.

(21) Appl. No.: 15/323,176

(22) PCT Filed: Apr. 8, 2015

(86) PCT No.: PCT/JP2015/061010

§ 371 (c)(1),
(2) Date: Dec. 30, 2016

(87) PCT Pub. No.: WO2016/002292

PCT Pub. Date: Jan. 7, 2016

(65) Prior Publication Data

US 2017/0157752 A1 Jun. 8, 2017

(30) Foreign Application Priority Data

Jun. 30, 2014 (JP) ..... 2014-134248

(51) Int. Cl.
*B25B 21/00* (2006.01)
*B25B 23/14* (2006.01)
(Continued)

(52) U.S. Cl.
CPC ..... *B25B 21/008* (2013.01); *B25B 21/00* (2013.01); *B25B 23/147* (2013.01);
(Continued)

(58) Field of Classification Search
CPC ... B25B 21/00; B25B 21/008; B25B 23/1415; B25B 23/147; B25F 5/02; B25F 5/001
See application file for complete search history.

(56) References Cited

U.S. PATENT DOCUMENTS

2013/0269961 A1* 10/2013 Lim ..... B25F 5/001 173/1
2014/0005820 A1* 1/2014 Roehm ..... G05B 11/01 700/168
2015/0306749 A1* 10/2015 Hsu ..... B25B 21/008 173/176

FOREIGN PATENT DOCUMENTS

JP S55-24853 A 2/1980
JP S56-146680 A 11/1981
(Continued)

OTHER PUBLICATIONS

Jun. 30, 2015 International Search Report issued in International Patent Application No. PCT/JP2015/061010.
(Continued)

*Primary Examiner* — David B Thomas
(74) *Attorney, Agent, or Firm* — Oliff PLC

(57) ABSTRACT

An operation switch sends an ON signal to a control processor indicating the operation switch is triggered by a user. A magnetic sensor sends a sensor signal to the control processor based on a displacement of a chip rod in a rearward direction. In the case where the sensor signal has not yet been sent, the control processor performs a control in a first mode where a brushless DC motor is not driven. In the case where sensor signal is sent, control processor performs a control in a second mode wherein the brushless DC motor is driven. An output in the first mode is lower than in the second mode. Because of this manner of construction, even if an ON input is triggered and held by the user, electric power is conserved while the operation switch is switched
(Continued)

on and a hexagonal nut is not fastened, improving power consumption efficiency.

10 Claims, 6 Drawing Sheets

(51) Int. Cl.
*B25F 5/00* (2006.01)
*B25F 5/02* (2006.01)
*B25B 23/147* (2006.01)

(52) U.S. Cl.
CPC ..... *B25B 23/1415* (2013.01); *B25F 5/001* (2013.01); *B25F 5/02* (2013.01)

(56) References Cited

FOREIGN PATENT DOCUMENTS

| | | | |
|---|---|---|---|
| JP | S63-120085 | A | 5/1988 |
| JP | 2000-079571 | A | 3/2000 |
| JP | 2009-160719 | A | 7/2009 |
| JP | 2009-297858 | A | 12/2009 |

OTHER PUBLICATIONS

Jun. 30, 2015 Written Opinion issued in International Patent Application No. PCT/JP2015/061010.

* cited by examiner

NUT-FASTENING TOOL

TECHNICAL FIELD

The present invention relates to a nut-fastening tool for fastening a nut on a bolt.

BACKGROUND ART

In recent years, bolts called Torshear Bolts (hereinafter referred to as "shear bolts") have been used for screw-fastening in steel-frame buildings, where they are screw-fastened by nuts. Screw-fastening by a nut is performed in a two-stage double fastening, i.e., primary fastening and final fastening. A nut-fastening tool, which is disclosed in Japanese Patent Publication No. 2009-297858, has been used for fastening such a type of nut. The above-described nut-fastening tool can be turned on by pulling an operation trigger that is provided in a tool main body.

SUMMARY OF INVENTION

At construction sites, there are cases where a nut is fastened to a plurality of shear bolts consecutively. In such cases, some users say that it is troublesome to switch off the tool every time the above-described nut-fastening tool is used. In this type of situation, it thus may be more convenient to keep the operation trigger pulled while a fastening operation of a nut to a plurality of shear bolts is performed.

However, while the operation trigger is held in a pulled position, redundant power that is not related to a fastening operation may be consumed during the time period from when a (first) nut is fastened until the time when another (the second) nut is fastened. In addition, some of the above-described nut-fastening tools use a rechargeable battery as a power source. A nut-fastening tool using a rechargeable battery as a power source particularly has limited electric power, which is supplied from the rechargeable battery. Because of this reason, unneeded redundant electric power, which is not related to a fastening operation as described above, may be consumed and unnecessarily reduce the already limited electric power of the rechargeable battery. There is thus a strong need to suppress such redundant power consumption.

There is a need in the art is to suppress redundant power consumption and improve power consumption efficiency even if an a user's hand keeps the nut-fastening tool in an on position for a prolonged period of time.

SUMMARY

A nut-fastening tool according to the first aspect of the present invention has a motor, a controller for controlling driving of the motor, and a wrench portion for fastening a nut on a bolt by driving the motor. The wrench has a nut-engaging portion with which the nut to be fastened is engaged, a displacement member that is displaced by engagement of the nut with the nut-engaging portion, and a displacement detection portion that transmits to the controller a displacement detection signal when the displacement member is displaced indicating the displacement.

In the nut-fastening tool according to the first aspect, the controller is configured such that the controller controls the motor in a first mode when the displacement detection signal is not sent. The controller is further configured such that the controller controls the motor in a second mode when the displacement detection signal is sent. Furthermore, the controller is configured such that an output of the motor that is controlled in the first mode is lower than that of the motor that is controlled in the second mode.

According to the nut-fastening tool of the first aspect, the motor is controlled in the first mode when the displacement detection signal is not sent. The output of the motor as controlled in the first mode is configured to be lower than that of the motor controlled in the second mode, and accordingly until the nut is engaged with the nut-engaging portion, the motor is controlled with a low output. Because of this control paradigm of motor output, electric power supplied to the motor can be saved while the nut is not fastened, and thus redundant electric power can be minimized and efficiency of power consumption can be improved.

The nut-fastening tool according to the second aspect of the present invention has a motor, a controller for controlling driving of the motor, and a wrench portion for fastening a nut on a bolt by driving the motor. The wrench portion has a nut-engaging portion with which the nut to be fastened is engaged, and an engagement detection portion that transmits to the controller an engagement detection signal indicating that the nut is engaged with the nut-engaging portion. The controller is configured such that the controller controls the motor in a first mode when the engagement detection is not sent, and in a second mode when the engagement detection signal is sent. Furthermore, the controller is configured such that an output of the motor that is controlled in the first mode is lower than that of the motor that is controlled in the second mode.

According to the nut-fastening tool of the second aspect, the motor is controlled in the first mode when the engagement detection signal is not sent. The output of the motor as controlled in the first mode is configured to be lower than that of the output of the motor as controlled in the second mode, and accordingly until the nut is engaged with the nut-engaging portion, the motor is controlled with a lower output in the first mode than that of the second mode. Because of this control paradigm of the motor output, while the nut is not fastened, electric power supplied to the motor can be saved, and thus redundant electric power can be minimized and efficiency of power consumption can be improved.

The nut-fastening tool according to the third aspect of the present invention is configured such that the control paradigm of the motor in the second mode of the first or second aspects comprises fastening the nut that is engaged with the nut-engaging portion. According to the third aspect of the nut-fastening tool, such a control paradigm enables the nut to be fastened when it is engaged with the nut-engaging portion.

The nut-fastening tool according to the fourth aspect of the present invention is configured such that the nut-fastening tool of the previous aspects has an operation input portion that transmits to the controller an ON signal when a user performs an ON input upon turning the device on, where the signal shows that the ON input was made. Additionally, the control paradigm of the motor in the first mode is such that when the controller receives the ON signal, the motor is not driven and the nut-engaging portion is not moved.

According to the nut-fastening tool of the fourth aspect, the control of the motor in the first mode is a control by which the motor is not driven, where the nut-engaging portion is not moved, and accordingly in a case where the nut is not fastened, electric power is not supplied to the motor. Because of this mode of control, electric power can be furthermore saved, and efficiency of the power consumption can be furthermore improved.

The nut-fastening tool according to the fifth aspect of the present invention is configured such that the nut-fastening tool of the first to third aspects has an operation input portion that transmits to the controller an ON signal when a user performs an ON input upon turning the device on, where the signal shows that the ON input was made. Additionally, the control paradigm of the motor in the first mode is such that when the controller receives the ON signal, the motor is rotated in a normal direction and in an adverse direction alternately such that the nut-engaging portion is joggled.

According to the fifth aspect of the nut fastening tool, the control paradigm of the motor in the first mode is such that the nut-engaging portion is joggled by the ON input the user performs. Such a control paradigm enables the nut to be easily engaged with the nut-engaging portion, and thus operability of the nut-fastening tool can be improved.

The nut-fastening tool according to the sixth aspect of the present invention is configured such that the nut-fastening tool of the first to third aspects further comprises an operation input portion that transmits to the controller an ON signal when a user performs an ON input upon turning the device on, where the signal shows the ON input was made. Additionally, the control paradigm of the motor in the first mode is such that when the controller receives the ON signal, the motor is rotated more slowly than in the second mode such that the nut-engaging portion is rotated slowly.

According to the sixth aspect of the nut-fastening tool, the control paradigm of the motor in the first mode is such that the nut-engaging portion is rotated slowly by the ON input the user performs. Such a control paradigm enables the nut to be easily engaged with the nut-engaging portion, and thus operability of the nut-fastening tool can be improved.

DETAILED DESCRIPTION

Figure 1:
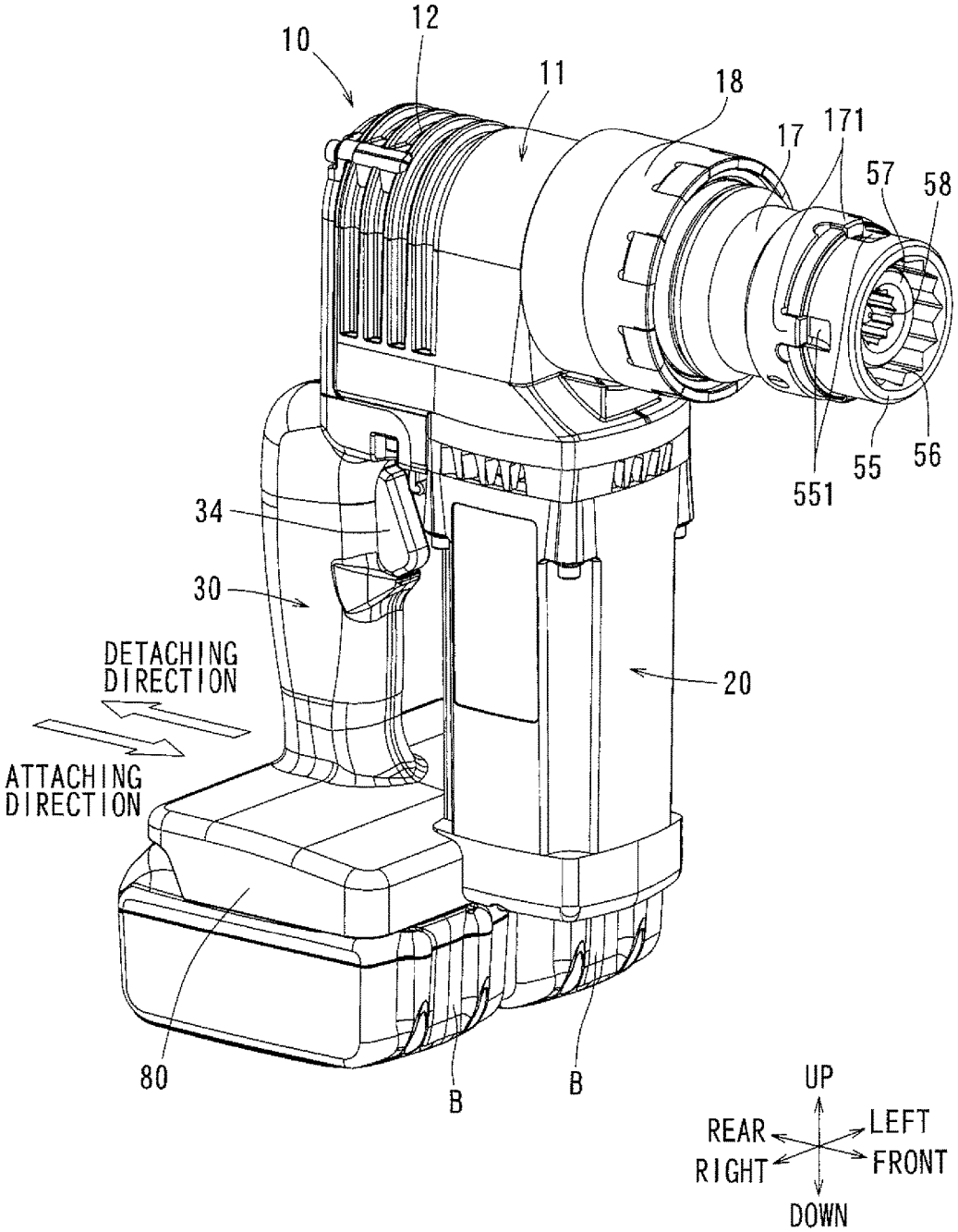
FIG. 1 is an external perspective view of a nut-fastening tool in which an overall appearance of the nut-fastening tool is viewed obliquely.
Figure 2:
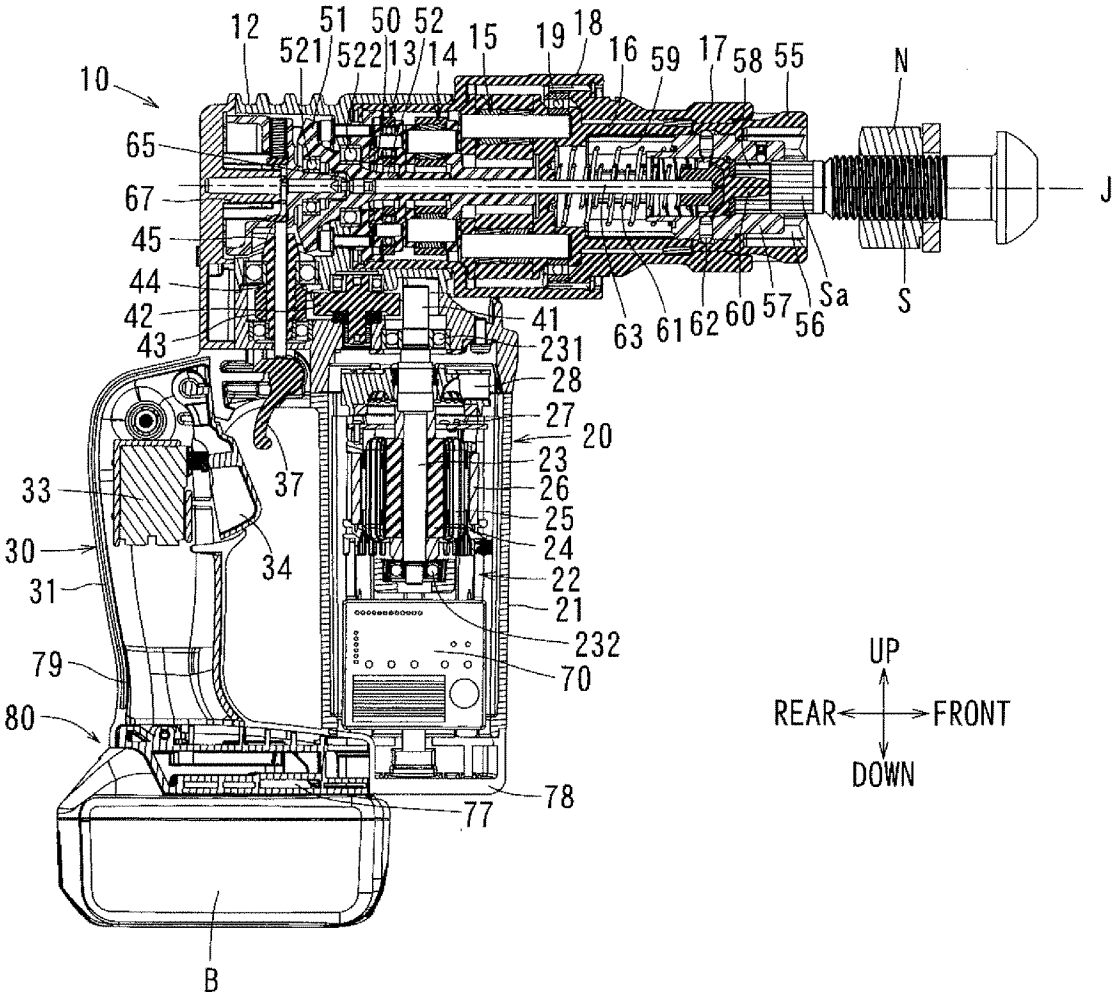
FIG. 2 is an internal structure view showing an internal structure of the nut-fastening tool. This figure shows a state before a chip portion of a shear bolt is inserted to an inner socket.
Figure 3:
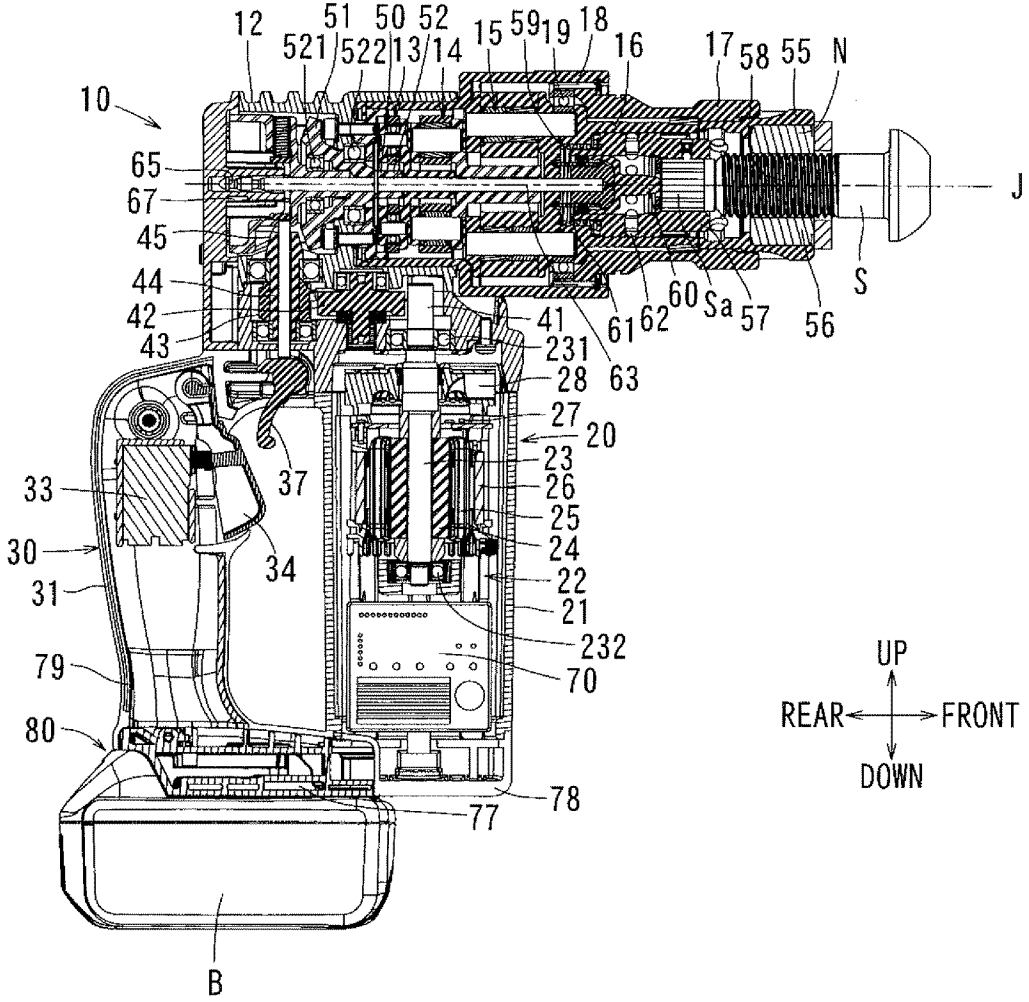
FIG. 3 is a left-right split internal structure view showing an internal structure of the nut-fastening tool. This figure shows a state in which the chip portion of the shear bolt is inserted to the inner socket.

An embodiment of the nut-fastening tool according to the present invention will be explained below. A perspective view of the embodiment is shown in FIG. 1, obliquely illustrating an external perspective view of a nut-fastening tool 10. Cross-sectional views are shown in FIGS. 2 and 3, illustrating the internal structure of the nut-fastening tool 10. FIG. 2 illustrates a state before a chip portion Sa of a shear bolt S is inserted to an inner socket 57, and FIG. 3 illustrates a state after the chip portion Sa of the shear bolt S has been inserted into the inner socket 57.

The nut-fastening tool 10 will be explained below based on the front, rear, upper, lower, left, and right sides of the drawings. The nut-fastening tool 10 shown in the figures may be referred to as a shear wrench. The nut-fastening tool 10 may be used for screw-fastening a hexagonal nut N to the shear bolt S. The nut-fastening tool 10 may include a function of fastening the hexagonal nut N to the shear bolt S and a function of shearing (cutting) the chip portion Sa provided at a tip end of the shear bolt S.

As shown in FIG. 1, etc., the nut-fastening tool 10 may generally include a tool main body 11, a motor portion 20, and a handle portion 30. Generally speaking, the tool main body 11 may perform the fastening function and the shearing function as described above by receiving a rotation drive from the motor portion 20. The tool main body 11 may correspond to a wrench portion according to the present invention in which the hexagonal nut N is fastened to the shear bolt S. The motor portion 20 and the handle portion 30 may be disposed below the tool main body 11. The motor portion 20 may have a brushless DC motor to generate a rotational drive force. The handle portion 30 may form a D shape when viewed in a lateral direction, such that a user can easily hold it.

The motor portion 20 may be configured such that the brushless DC motor 22 is housed in a motor housing 21. The brushless DC motor 22 may correspond to a motor according to the present invention. The brushless DC motor 22 may include a motor shaft 23, a rotor 24, a coil 25, an insulator 26, and a sensor PCB 27. The motor shaft 23 may be an axis of the rotor 24 and extend in an up-and-down direction. The motor shaft 23 may be rotatably supported by bearings 231 and 232 that are vertically disposed. These bearings 231 and 232 may be supported by the motor housing 21.

The rotor 24 may be supported by the motor shaft 23. The coil 25 and the insulator 26 may be disposed around the rotor 24 and supported by the motor housing 21. The sensor PCB 27 may be disposed above the rotor 24 and electrically connected to a controller 70 that will be explained infra. The sensor PCB 27 may be configured to use a hall element to detect rotation of the rotor 24. The sensor PCB 27 may correspond to a motor position detection portion according to the present invention. The sensor PCB 27 may transmit a position signal to a control processor 71 (symbol 71 shown in FIG. 4) of the controller 70 based on rotation of the rotor 24. Furthermore, a cooling fan 28 for cooling mainly the coil 25 may be attached to the motor shaft 23.

The handle portion 30 may be a portion that is held by a user's hand. The handle portion 30 may extend in a direction intersecting an axle J of the tool main body 11, which is a rotation axis around which the hexagonal nut N is fastened. The handle portion 30 may be formed based on an external shape of a handle housing 31. For the handle housing 31, a grip shape may be selected in such a way that a user may easily hold it. An operation switch 33 may be provided inside the handle housing 31. The operation switch 33 may correspond to an operation input portion according to the present invention.

The operation switch 33 may be configured to switch on or off by a user's hand. More precisely, the operation switch 33 may be switched on by pulling a switch lever 34 provided in front of the handle portion 30, and automatically switched off when the pulling operation is stopped. When the operation switch 33 is switched on, the operation switch 33 may transmit an ON signal to the controller 70 (the control processor 71) indicating that the operation switch 33 is switched on. On the contrary, when the operation switch 33 is switched off, the operation switch 33 may not transmit the ON signal to the controller 70 (the control processor 71) indicating the operation switch 33 is switched on.

A rotational drive force of the motor shaft 23 may be transferred to the tool main body 11. In particular, a pinion gear 41 may be provided at a tip of the motor shaft 23. The pinion gear 41 may be engaged with a first intermediate gear 42. Furthermore, the first intermediate gear 42 may be engaged with a second intermediate gear 43. Because of this manner of construction, the rotational drive force of the motor shaft 23 may be transferred to an intermediate shaft 44 via the two intermediate gears 42 and 43. A bevel gear 45 may be provided at a tip of the intermediate shaft 44.

The bevel gear 45 may be engaged with an input bevel gear 51 of the tool main body 11. As a result, the rotational drive force of the intermediate shaft 44 may be transferred to an input shaft 50 that is formed integrally with the input bevel gear 51. The input shaft 50 may be rotatably supported by bearings 521 and 522. A rotation axis of the input shaft 50 may correspond to the axle J of the tool main body 11.

A first stage sun gear 52 may be provided at a tip of the input shaft 50. The first stage sun gear 52 may be engaged with a first stage planet gear 13 to transfer the rotational drive force of the input shaft 50. A rotational drive force of the first stage planet gear 13 may be transferred to a second stage planet gear 14. Furthermore, a rotational drive force of the second stage planet gear 14 may be transferred to a third stage planet gear 15. A rotational drive force of the third stage planet gear 15 may be transferred to an inner sleeve 16 and an outer sleeve 17.

The inner sleeve 16 and the outer sleeve 17 may be rotatable around the axle J. The outer sleeve 17 may be integrally formed with respect to a front housing 18 so as to be collectively rotatable around the axle J. The front housing 18 may be rotatably supported around the axle J with respect to a main body housing 12.

The outer sleeve 17 may be rotated together with the front housing 18. The inner sleeve 16 may be rotatably supported by an inner ring of the bearing 19. The outer sleeve 17 and the front housing 18 may be rotatably supported by an outer ring of the bearing 19. An outer socket 55 may be joined to a front end terminus of the outer sleeve 17. A nut-engaging portion 56 with which the above-described hexagonal nut N can be engaged may comprise a concentric surface extending from the interior circumferential surface of the outer socket 55. The nut-engaging portion 56 may thus comprise structure with which the hexagonal nut N is engaged when the hexagonal nut N is fastened.

The outer socket 55 may be joined so as to be axially displaceable with respect to the outer sleeve 17 and relatively independently non-rotatable around the axis. The outer socket 55 may be coaxially disposed with respect to the inner sleeve 16. The outer socket 55 can be removed by being axially displaced in the forward direction with respect to the outer sleeve 17. The inner socket 57 may be supported on an inner circumference of the inner sleeve 16 and the coaxial outer socket 55. The inner socket 57 may be biased axially forward with respect to the inner sleeve 16 by a compression spring 59.

The outer socket 55 can also be displaced axially rearward against the compression spring 59 such that the outer socket 55 approaches the outer sleeve 17. At this time, as shown in FIG. 1, a female guide portion 551 of the outer socket 55 may be guided by a male guide portion 171 of the outer sleeve 17. An outer circumference of the inner socket 57 may be spline-fitted to an inner circumference of the inner sleeve 16. Because of this fit, the inner sleeve 16 together with the inner socket 57 may be rotated around the axle J.

A chip-engaging portion 58 may be provided on the inner circumferential surface of the inner socket 57. A slide prevention pin 60 may protrude within the chip-engaging portion 58. The slide prevention pin 60 may be biased by a compression spring 61 in a protruding direction axially forward with respect to the inner socket 57. When the chip portion Sa completely engages the chip-engaging portion 58 of the inner socket 57, the slide prevention pin 60 may be pushed axially backward from within the chip-engaging portion 58. At that time, a stopper 62 provided in a circumferential groove within the inner socket 57 originally pushed circumferentially outward by the pin 60, may then protrude inward in a biased manner to an inner circumferential position of the inner socket 57, and can be moved to a rear side of the inner sleeve 16.

In other words, because of this mode of construction, unless the chip portion Sa is completely engaged with the chip-engaging portion 58 of the inner socket 57, the hexagonal nut N cannot be engaged with the nut-engaging portion 56 of the outer socket 55. In this way, slippage of the chip portion Sa may be prevented.

The slide prevention pin 60 may be formed integrally with a chip rod 63 so as to be movable together with the chip rod 63. In particular, when the chip portion Sa is inserted into the chip-engaging portion 58 of the inner socket 57, the slide prevention pin 60 and the chip rod 63 may be collectively pushed back against the compression spring 61. Furthermore, when the chip portion Sa is completely inserted within the chip-engaging portion 58, the inner socket 57 may be pushed back against the compression spring 61.

As shown in FIG. 3, the hexagonal nut N may be engaged with the nut-engaging portion 56 of the outer socket 55. As described earlier, the inner socket 57 may be spline-fitted to the inner sleeve 16. The hexagonal nut N may be fastened to the shear bolt S by the transferred rotational drive force from the brushless DC motor 22, which makes the outer socket 55 rotate.

The hexagonal nut N may thus be fastened by rotation of the outer socket 55. In this manner, a fastening procedure of the hexagonal nut N may eventually reach a final stage, which means completion of the fastening. When rotation of the outer socket 55 stops, a reaction torque due to the stoppage of rotation may be applied to the outer socket 55. Subsequently, the reaction torque may be transmitted to the third stage planet gear 15, which may rotate the inner socket 57 in a direction opposite the fastening direction of the hexagonal nut N. Such rotation force of the inner socket 57 may work to shear the chip portion Sa of the shear bolt S.

In this way through the reaction torque, a shearing force may be applied to the chip portion Sa of the shear bolt S, and the chip portion Sa may be sheared (cut). The sheared chip portion Sa may be ejected from the chip-engaging portion 58 by a projecting force of the slide prevention pin 60 in the forward direction. An ejection lever 37 may be provided above the switch lever 34. When the ejection lever 37 is pulled, the chip rod 63 may be forced to move in the forward direction. The chip rod 63 that is forced to move in the forward direction may then eject the sheared chip portion Sa from the chip-engaging portion 58.

In the nut-fastening tool 10, rechargeable batteries B that are detachable as a power source may be used. In more detail, a battery attachment structure in which two rechargeable batteries B, B can be attached may be provided at a lower portion of the handle portion 30. The battery attachment structure 80 may be provided extending between both the lower portion 78 of the motor portion 20 and the lower portion 79 of the handle portion 30.

On the lower surface of the battery attachment structure 80, a pair of battery attachment portions 77 to which two rechargeable batteries B can be detachably attached may be provided in parallel. The battery attachment portions 77 may have a structure in which both the rechargeable batteries B, B can be detachably attached by an identical sliding operation along the front-rear axis. Each of the rechargeable batteries B may be configured to be a rechargeable battery that can be detachably attached to the battery attachment portion 77 by the described slide operation.

The battery attachment portions 77 that are arranged in a parallel physical configuration may be electrically connected to each other in series. In other words, two rechargeable batteries B whose rated voltages are 18V may be attached, and a sum voltage of 36V can be utilized as a supposed rated voltage. The rechargeable batteries B, B, each of which is attached to a respective battery attachment portion 77, may be electrically connected to the controller 70, which will be explained infra. Furthermore, electric power of the rechargeable batteries B may be applied to the coil 25 of the brushless DC motor 22. In this way, the nut-fastening tool 10 may be operated by a DC power source applied from the rechargeable batteries B.

Figure 4:
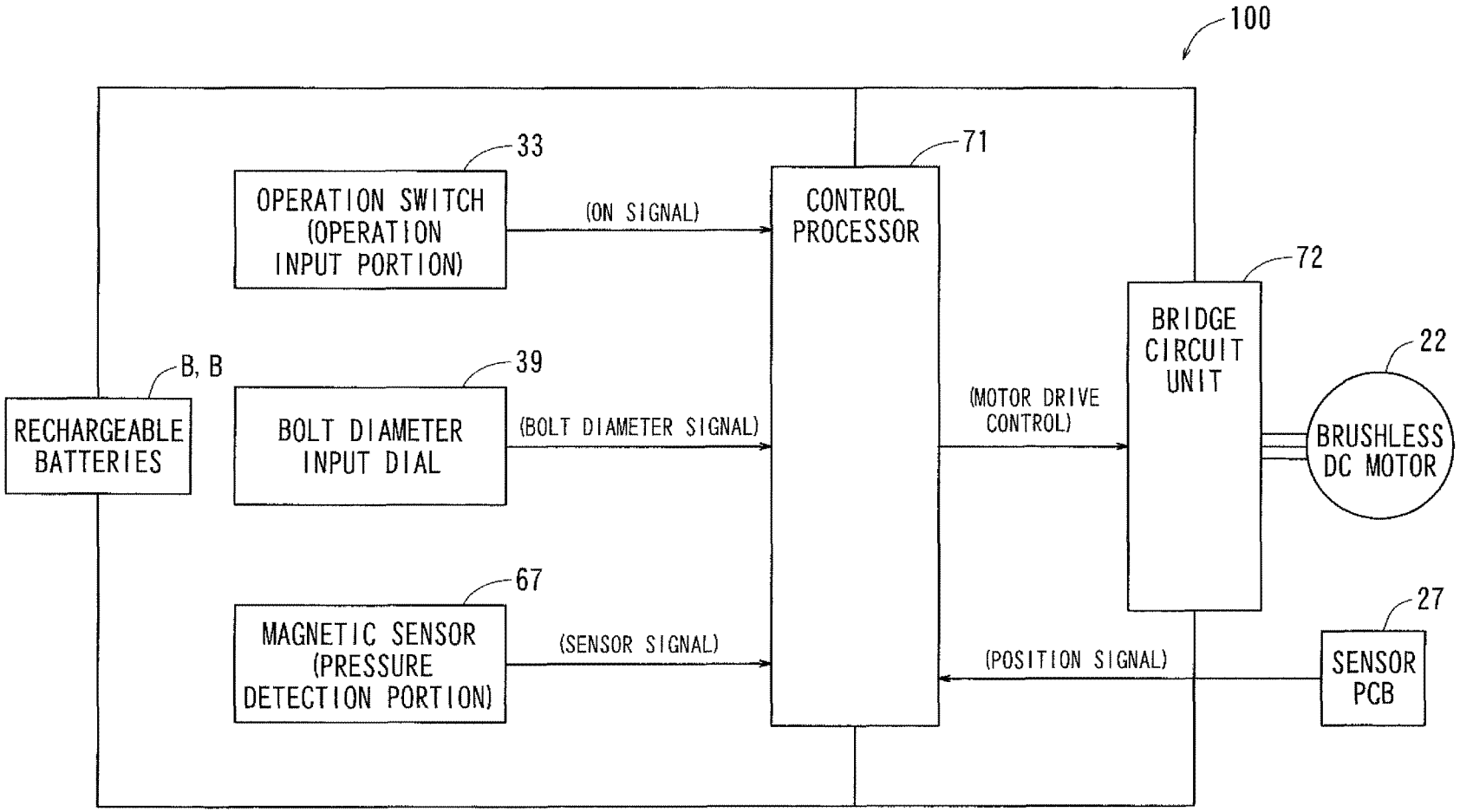
FIG. 4 is a block diagram schematically showing a drive system of a brushless DC motor.

The above-described motor portion 20 may be provided with the controller 70. The controller 70 may control electric power supply with respect to the rotation drive of the brushless DC motor 22. The controller 70 may be housed at a lower part of the motor housing 21 that is located below the brushless DC motor 22. The controller 70 may correspond to a controller according to the present invention. The block diagram shown in FIG. 4 schematically illustrates a drive system 100 of the brushless DC motor 22. As shown in FIG. 4, the controller 70 may include the control processor 71 and a bridge circuit unit 72.

A bolt diameter input dial 39 which is not shown in FIGS. 1-3 may be provided below the controller 70. The bolt diameter input dial may be a structure in which a user may input a diameter of the bolt to which the hexagonal nut N is fastened. In more detail, there may be M16, M20, M22, and M24 as standards for the diameter of the bolt to which the hexagonal nut N is fastened. By use of the bolt diameter input dial, the user may select any one of the standards M16, M20, M22, and M24 for a diameter of the bolt to which the hexagonal nut N is fastened.

Furthermore, the bolt diameter input dial may be electrically connected to the control processor 71 of the controller 70 which will be explained infra. FIG. 4, in which the block diagram of the drive system 100 is shown, illustrates the bolt diameter input dial, referred to by symbol 39. The bolt diameter input dial 39 may transmit a corresponding bolt diameter signal to the control processor 71 based on the selected bolt diameter.

The control processor 71 may include a CPU (central processing unit) and appropriate storage medium. The bridge circuit unit 72 may comprise a switching circuit for driving the above-mentioned brushless DC motor 22. In more detail, the bridge circuit unit 72 may have FETs (field effect transistors) as switching elements and may be controlled by the control processor 71. Furthermore, the control processor 71 may detect a battery voltage of the rechargeable batteries B attached to the battery attachment portion 77 from an input which is not shown in the figures. Electric power may be directly supplied to the bridge circuit unit 72 from the rechargeable batteries B, and electric wiring may be formed such that electric power can be supplied to the coil 25 of the brushless DC motor 22.

As shown in FIGS. 2 and 3, disposition of the chip rod 63 may differ depending on whether the chip portion Sa of the shear bolt S is inserted to the chip-engaging portion 58 of the inner socket 57 or not. In particular, when the chip portion Sa is not inserted into the chip-engaging portion 58, the chip rod 63 may not be moved by the chip portion Sa and may be disposed as shown in FIG. 2. That is, the chip rod 63 may be disposed in a front-oriented position as shown in FIG. 2 by receiving a forward biasing force of the compression spring 61.

On the other hand, when the chip portion Sa is inserted into the chip-engaging portion 58, the chip rod 63 may be moved rearward by the inserted chip portion Sa against the biasing force of the compression spring 32. The chip rod 63 may be disposed at a rear position as shown in FIG. 3. In this way, the chip rod 63 may be a member that is displaced by engagement of the hexagonal nut N with the nut-engaging portion 56, and correspond to a displacement member in the present invention.

At this time, the tool main body 11 as a wrench may receive a pressure in a direction opposite the fastening direction of the hexagonal nut N. That is, the tool main body 11 may receive a pressure by engagement of the hexagonal nut N with the nut-engaging portion 56. The chip rod 63 may be disposed at the rear position as shown in FIG. 3, and the tool main body 11 may be configured to detect that the tool main body 11 receives a pressure by engagement of the hexagonal nut N. In more detail, a magnetic sensor 67, which detects a rear end portion 65 of the chip rod 63 when the chip rod 63 is disposed at the rear position as shown in FIG. 3, may be provided inside the tool main body 11.

When the chip rod 63 is disposed at the rear position as shown in FIG. 3, the magnetic sensor 67 may detect that the rear end portion 65 of the chip rod 63 is disposed as shown in FIG. 3. On the contrary, when the chip rod 63 is disposed at the front position as shown in FIG. 2, the magnetic sensor 67 does not detect the rear end portion 65 of the chip rod 63. In this way, the magnetic sensor 67 detects the rear end portion 65 of the chip rod 63 only when the chip rod 63 is in the rearward position as shown in FIG. 3, and does not detect the rear end portion 65 of the chip rod 63 when the chip rod 63 is disposed in the frontward position as shown in FIG. 2.

When the magnetic sensor 67 detects the rear end portion 65 of the chip rod 63, a corresponding sensor signal may be transmitted to the controller 70 (control processor 71). The corresponding sensor signal may correspond to both a displacement detection signal and an engagement detection signal in the present invention. Similarly, the magnetic sensor 67 may correspond to both a pressure detection portion and an engagement detection portion of the present invention. Furthermore, the magnetic sensor 67 may also correspond to a displacement detection portion of the present invention. The magnetic sensor 67 may transmit the sensor signal (displacement signal) to the control processor 71 based on the displacement of the chip rod 63 as the displacement member in the rearward direction. Furthermore, the sensor signal transmitted from the magnetic sensor 67 may also correspond to a pressure signal and an engagement signal of the present invention.

When the magnetic sensor 67 detects the rear end portion 65 of the chip rod 63 as shown in FIG. 3, the magnetic sensor 67 may transmit a sensor signal to the controller 70 (control processor 71), the signal indicating that the tool main body 11 has received pressure in a direction opposite to the fastening direction of the hexagonal nut N. Additionally, when the magnetic sensor 67 detects the rear end portion 65 of the chip rod 63 as shown in FIG. 3, the magnetic sensor 67 may also transmit a sensor signal to the controller 70 (control processor 71) indicating that the hexagonal nut N is engaged with the outer socket 55.

Figure 5:
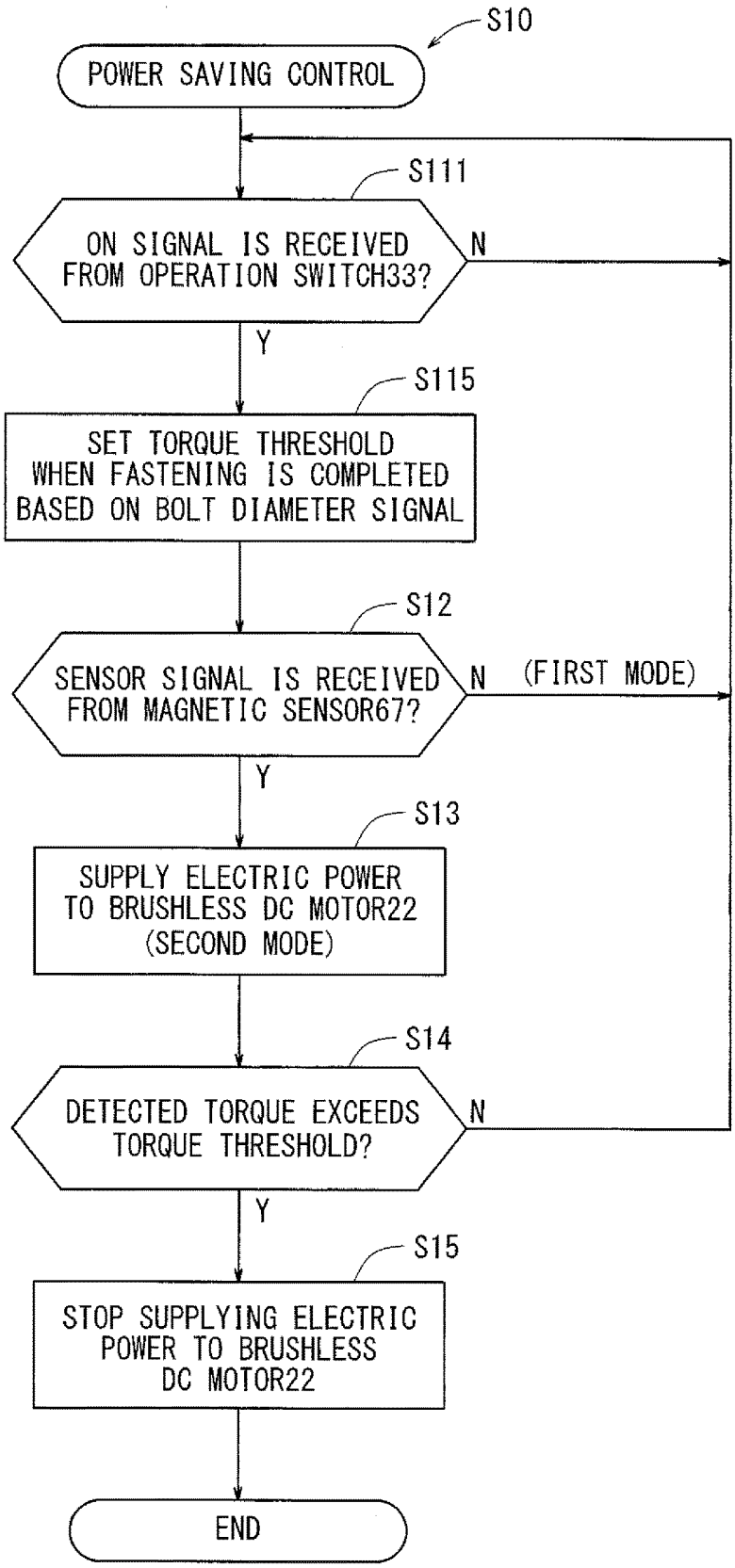
FIG. 5 is a flowchart showing a flow of a power-saving control.
Figure 6:
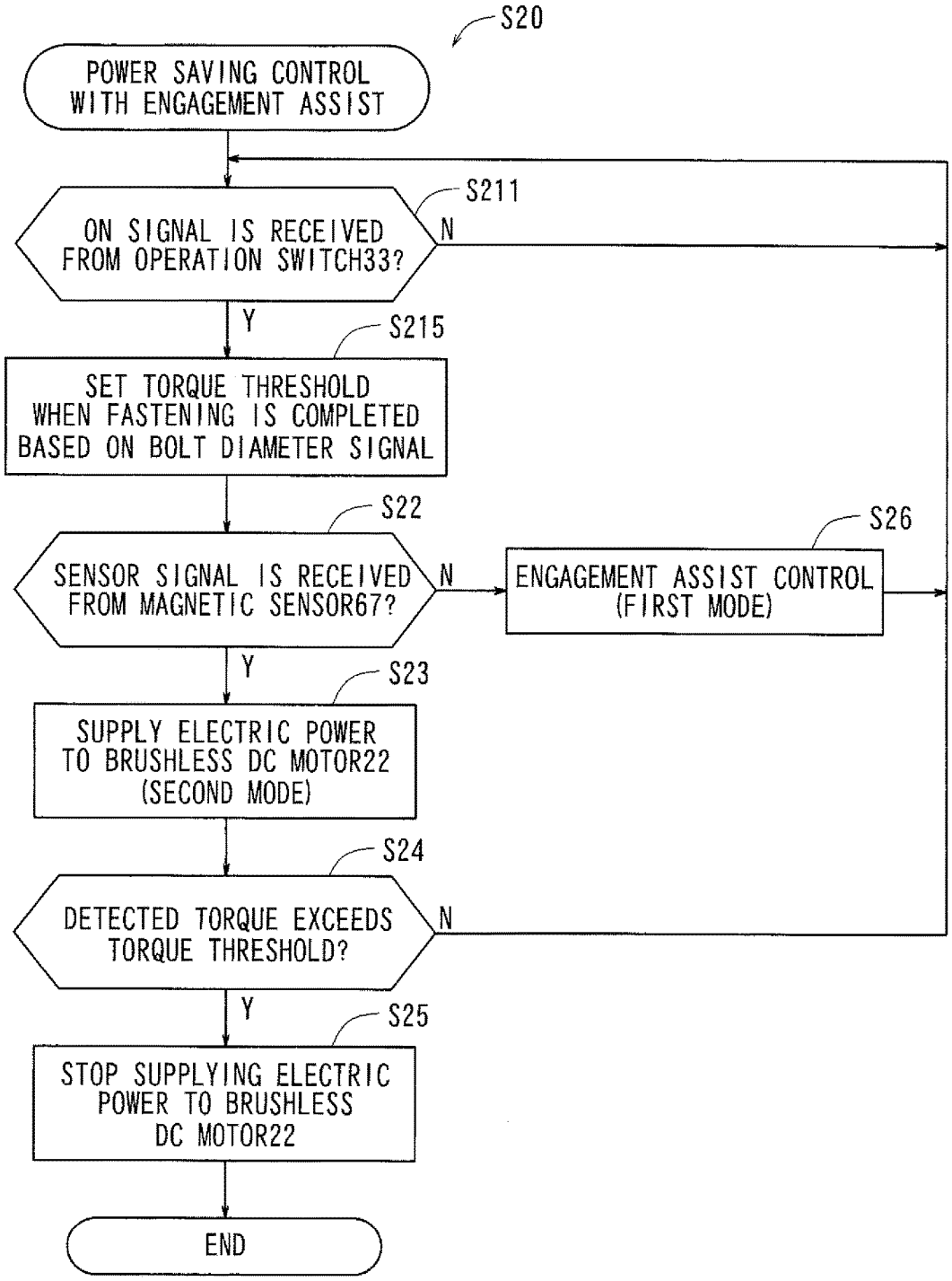
FIG. 6 is a flowchart showing a flow of a power-saving control with an engagement assist.

The above-described configurations may comprise the drive system 100 as shown in the block diagram of FIG. 4. Power saving control regimes as shown in FIGS. 5 and 6 may be implemented by the drive system 100. The flowchart of FIG. 5 shows a flow of a power saving control. The flowchart of FIG. 6 shows a flow of a power saving control with an engagement assist. The above-described control processor 71 may perform and implement, for example, the power saving control as shown in FIG. 5 when electric power is supplied to the brushless DC motor 22.

In the power saving control regime of FIG. 5, at step S10, at first, it may be judged whether the control processor 71 has received an ON signal from the operation switch 33 (S111). In S111, when it is judged that the control processor 71 has received the ON signal from the operation switch 33, a process may transfer to a torque threshold setting procedure for fastening completion (S115). When it is judged that the control processor 71 does not receive the ON signal from the operation switch 33, this judgment may be repeatedly considered until the ON signal is received.

In S115, the control processor 71 may set a torque threshold of the brushless DC motor 22 when fastening is completed based on a bolt diameter signal transmitted from the aforementioned bolt diameter input dial 39. The torque threshold of the brushless DC motor 22 may include a threshold of the rotation number of the brushless DC motor, a threshold of a current value of electric power transmitted to the brushless DC motor 22, etc. The torque threshold set in S115 in this way may be utilized for a judgment of the torque threshold for fastening completion, which is performed later in step S14. After the torque threshold setting procedure for fastening completion (S115), the control regime may proceed to a judgment whether the control processor 71 receives a sensor signal from the magnetic sensor 67 (S12).

In S12, when the control processor 71 judges that the sensor signal is received from the magnetic sensor 67, the control processor 71 may then supply electric power to the brushless DC motor 22 (S13). Conversely, when the control processor 71 judges that the sensor signal is not yet received from the magnetic sensor 67 in S12, the judgment of S111 may be repeatedly considered until the sensor signal is received (S12). In other words, when the control processor 71 receives both the ON signal from the operation switch and the sensor signal from the magnetic sensor, the control processor 71 may supply electric power to drive the brushless DC motor 22 so as to fasten the hexagonal nut N to the nut-engaging portion 56, which corresponds to a second mode.

When the sensor signal is not sent, in a first mode the control processor 71 may not drive the brushless DC motor 22 so as to rotate the nut-engaging portion 56, resulting in no rotation. Consequently, the control output from the brushless DC motor 22 in the first mode is lower than in the second mode. Electric power supplied to the brushless DC motor 22 in S13 may be such that the brushless DC motor 22 is rotationally driven so as to fasten the hexagonal nut N to be engaged with the outer socket 55.

After that, the control processor 71 may judge whether a torque detected from the brushless DC motor 22 exceeds the torque threshold set in S115. In particular, in order to detect the torque, the control processor 71 may calculate a torque of the brushless DC motor 22 based on a position signal transmitted from the sensor PCB 27. Next, the control processor 71 may judge whether the detected torque exceeds the torque threshold set in S115. When the control processor 71 judges in S14 that the detected torque of the brushless DC motor 22 exceeds the torque threshold set in S115, the control processor 71 may stop supplying electric power to the brushless DC motor 22 (S15).

When the control processor 71 judges in S14 that the detected torque of the brushless DC motor 22 does not exceed the torque threshold set in S115, the control processor 71 may consider the judgments from S111 to S14 again in the same way (S111, S12). In other words, the control processor 71 may continue supplying electric power to the brushless DC motor 22 (S13). The torque that the control processor 71 detects as described above may be a rotation number of the brushless DC motor 22, which the control processor 71 calculates based on the position signal transmitted from the sensor PCB 27, or a value of the current flown through the brushless DC motor 22, which the control processor 71 detects for calculating.

Instead of the power saving control as described above, the control processor 71 may alternately perform a power saving control with an engagement assist, as shown in FIG. 6. A flowchart in FIG. 6 shows a flow diagram of the power saving control regime with the engagement assist (S20). In the power saving control with the engagement assist (S20), judgments and controls (S211-S25) may be performed in a roughly similar manner to the judgment and controls (S111-S15) that are performed in the power saving control regime in FIG. 5. However, in S22, when it is judged that the sensor signal is not received from the magnetic sensor 67, an engagement assist control may be performed in S 26.

The engagement assist shown in S26 may be a control in which electric power is supplied to the brushless DC motor 22 so as to engage the hexagonal nut N with the outer socket 55. That is, the control performed in S23 (S13) may differ from that in S16. The engagement assist control (S26) may be repeatedly performed until the hexagonal nut N is engaged with the outer socket 55 (S22, S26).

In the engagement assist control (S26), the control processor 71 may have received only the ON signal and may supply electric power to the brushless DC motor 22 so as to engage the hexagonal nut N with the nut-engaging portion 56. In other words, when both the ON signal and the sensor signal are received, the control processor 71 may supply electric power to drive the brushless DC motor 22 so as to fasten the hexagonal nut N engaged with the nut-engaging portion 56, which corresponds to the second mode. However, when the sensor signal is not sent and the ON signal is received, then the engagement assist control may be performed. The engagement assist control (S26) may correspond to a control in the first mode according to the present invention, in which electric power may be supplied to drive the brushless DC motor 22 so as to engage the hexagonal nut N with the nut-engaging portion 56.

Various kinds of controls may be selected for a specific control of the engagement assist control in S26. An example of the engagement assist control (S26) performed by the control processor 71 may be such that the brushless DC motor 22 is rotated alternately in a normal direction and in a reverse direction so as to joggle the nut-engaging portion 56. In more detail, the brushless DC control may be rotated in the normal and reverse directions alternately during a divided time period, which may be repeated several times. The control processor 71 may alternately perform current switching in the normal and reverse directions several times during the electric power supply to the brushless DC motor 22. This may cause the nut-engaging portion 56 (outer socket 55) to be finely rotated several times in the normal and reverse directions, and thus the hexagonal nut N may be easily engaged with the nut-engaging portion 56.

Furthermore, in the engagement assist control (S26), the control processor 71 may control the brushless DC motor 22 such that the brushless DC motor 22 may rotate more slowly than in the second mode (S23) so as to slowly rotate the nut-engaging portion 56. The rotation may be in the normal direction or in the reverse direction. The control processor 71 may supply electric power of smaller amplitude voltage to the brushless DC motor 22, than in the second mode. This may cause the nut-engaging portion 56 (outer socket 55) to rotate slowly in the normal direction or in the reverse direction, and thus the hexagonal nut N may be easily engaged in a guided-fit with the nut-engaging portion 56.

According to the above-described nut-fastening tool 10, the following effect may be obtained. That is, according to the above-described nut-fastening tool 10, the brushless DC motor may be controlled with a low voltage until the hexagonal nut N is engaged with the nut-engaging portion 56. Because of this control, electric power supplied to the brushless DC motor 22 can be conserved when the hexagonal nut N is not being fastened, and accordingly redundant power consumption may be restricted and improve electric power consumption efficiency. Furthermore, when the nut-engaging portion 56 is not rotated in the first mode, electric power is not supplied to the brushless DC motor 22 while the hexagonal nut N is not fastened. Because of this control regime, electric power can be further conserved and efficiency of electric power consumption furthermore improved. In addition, in a case where the control in the first mode is performed such that the nut-engaging portion 56 is joggled in alternate directions, the hexagonal nut N can be easily engaged with the nut-engaging portion 56, and thus operability of the nut-fastening toll 10 can be improved. Furthermore, in a case where the control in the first mode is such that the nut-engaging portion is rotated slowly, the hexagonal nut N can be easily engaged in a guided-fit with respect to the nut-engaging portion 56, and thus operability of the nut-fastening tool 10 can be improved.

The nut-fastening tool of the present invention is not limited to the embodiments discussed above and may be further modified. For example, in the embodiments discussed above, rechargeable batteries B may be used as the electric power source. However, instead of this, electric power can be obtained by a household power source (AC). Furthermore, in the embodiments discussed above, the brushless DC motor 22 may be used as a driving source. Instead of this, a brush motor can be used as the driving source.

Furthermore, in the embodiments discussed above, the chip rod 63 may be used as the displacement member. However, embodiments may not be limited to this member, and for example, a member formed by the outer socket 55 may be used as a displacement member. That is, a member that is displaceable by the engagement of the hexagonal nut N with the nut-engaging portion 56 may be used as a displacement member of the present invention.

Furthermore, in the embodiments discussed above, the magnetic sensor 67 may be used as the displacement detection portion and the engagement detection portion. However, embodiments may not be limited to this member, and for example, a member formed by a contact switch or a photo-sensor (optical sensor) may be used as a displacement detection portion and an engaging detection portion. In other words, a wide variety of configurations may be adopted for a displacement member according to the present invention, as long as a displacement detection signal can be sent to the controller showing that the displacement member is displaced.

Furthermore, a wide variety of configurations may be adopted for an engagement detection portion of the present invention, as long as an engagement detection signal can be sent to the controller indicating that the hexagonal nut is engaged with the nut-engaging portion. Furthermore, the above-described engagement assist control (S26) may not be limited to the first mode of the present invention, where an appropriate control regime can be adopted. For example, any configurations may be adopted as long as a control output of the motor in the first mode is lower than that in the second mode.

What is claimed is:

1. A nut-fastening tool, comprising:

a motor;

a controller for controlling the driving of the motor; and a wrench portion for fastening a nut on a bolt by driving the motor, wherein:

the wrench portion includes:

a nut-engaging portion with which the nut to be fastened is engaged;

a displacement member that is displaced by the engagement of the nut with the nut-engaging portion; and a displacement detection portion that transmits to the controller a displacement detection signal when the displacement member is displaced, the signal indicating that the displacement member has been displaced;

where the controller is configured such that:

the controller controls the motor in a first mode when the displacement detection signal is not sent;

the controller controls the motor in a second mode when the displacement detection signal is sent; and a power output of the motor that is controlled in the first mode is lower in amplitude than that of the motor controlled in the second mode.

2. The nut-fastening tool according to claim 1, wherein, the controller of the motor in the second mode implements a control regime where when the displacement detection signal has been received, it drives the motor to fasten the nut that is engaged with the nut-engaging portion.

3. The nut-fastening tool according to claim 1, wherein;

the nut-fastening tool further comprises an operation input portion that transmits to the controller an ON signal when a user triggers a switch indicating the ON input is made; and the control regime of the motor implemented by the controller in the first mode is such that when the controller receives only the ON signal and not another signal, then the motor is not driven such that the nut-engaging portion is not moved.

4. The nut-fastening tool according to claim 1, wherein;

the nut-fastening tool further comprises an operation input portion that transmits to the controller an ON signal when a user triggers a switch indicating the ON input is made; and the control regime of the motor implemented by the controller in the first mode is such that when the controller receives the ON signal, the motor is rotated in a normal direction as well as an adverse direction alternately in divided periods of time such that the nut-engaging portion is joggled.

5. The nut-fastening tool according to claim 1, wherein;

the nut-fastening tool further comprises an operation input portion that transmits to the controller an ON signal when a user triggers a switch indicating the ON input is made; and the control regime of the motor implemented by the controller in the first mode is such that when the controller receives the ON signal, the power amplitude transferred to the motor is lower than the second mode, such that the motor is rotated more slowly than in the second mode, resulting in the nut-engaging portion rotating slowly.

6. A nut-fastening tool, comprising:

a motor;

a controller for controlling the driving of the motor; and a wrench portion for fastening a nut on a bolt by driving the motor, wherein:

the wrench portion includes:

a nut-engaging portion with which the nut to be fastened is engaged; and an engagement detection portion that transmits to the controller an engagement detection signal, the signal indicating that the nut is engaged with the nut-engaging portion;

where the controller is configured such that:

the controller controls the motor in a first mode when the engagement detection signal is not sent;

the controller controls the motor in a second mode when the engagement detection signal is sent; and a power output of the motor that is controlled in the first mode is lower in amplitude than that of the motor controlled in the second mode.

7. The nut-fastening tool according to claim 6, wherein, the controller of the motor in the second mode implements a control regime where when the engagement detection signal has been received, it drives the motor to fasten the nut that is engaged with the nut-engaging portion.

8. The nut-fastening tool according to claim 6, wherein;

the nut-fastening tool further comprises an operation input portion that transmits to the controller an ON signal when a user triggers a switch indicating the ON input is made; and the control regime of the motor implemented by the controller in the first mode is such that when the controller receives only the ON signal and not another signal, then the motor is not driven such that the nut-engaging portion is not moved.

9. The nut-fastening tool according to claim 6, wherein;

the nut-fastening tool further comprises an operation input portion that transmits to the controller an ON signal when a user triggers a switch indicating the ON input is made; and the control regime of the motor implemented by the controller in the first mode is such that when the controller receives the ON signal, the motor is rotated in a normal direction as well as an adverse direction alternately in divided periods of time such that the nut-engaging portion is joggled.

10. The nut-fastening tool according to claim 6, wherein;

the nut-fastening tool further comprises an operation input portion that transmits to the controller an ON signal when a user triggers a switch indicating the ON input is made; and the control regime of the motor implemented by the controller in the first mode is such that when the controller receives the ON signal, the power amplitude transferred to the motor is lower than the second mode, such that the motor is rotated more slowly than in the second mode, resulting in the nut-engaging portion rotating slowly.

* * * * *